US008434765B1

(12) United States Patent
Taylor

(10) Patent No.: US 8,434,765 B1
(45) Date of Patent: May 7, 2013

(54) ILLUMINATED SKEET TARGET

(76) Inventor: Eugene Taylor, Rancho Cucamonga, CA (US)

( * ) Notice: Subject to any disclaimer, the term of this patent is extended or adjusted under 35 U.S.C. 154(b) by 270 days.

(21) Appl. No.: 13/004,949

(22) Filed: Jan. 12, 2011

Related U.S. Application Data

(63) Continuation-in-part of application No. 12/154,953, filed on May 28, 2008, now abandoned.

(60) Provisional application No. 60/932,055, filed on May 29, 2007.

(51) Int. Cl.
*F41J 9/16* (2006.01)

(52) U.S. Cl.
USPC ..... 273/362; 446/47; 473/570

(58) Field of Classification Search ..... 273/362–365; 124/6–9; 446/46, 47; 473/570
See application file for complete search history.

(56) References Cited

U.S. PATENT DOCUMENTS

| | | | | |
|---|---|---|---|---|
| 2,568,279 | A | 9/1951 | Franz et al. | |
| 3,176,988 | A | 4/1965 | DeFerdinado | |
| 3,502,333 | A | 3/1970 | Fleury | |
| 3,576,987 | A * | 5/1971 | Voight et al. | 362/34 |
| 4,086,723 | A * | 5/1978 | Strawick | 446/47 |
| 4,254,575 | A * | 3/1981 | Gould | 446/46 |
| 4,623,150 | A | 11/1986 | Moehlman et al. | |
| 4,814,949 | A * | 3/1989 | Elliott | 362/34 |
| 4,846,475 | A * | 7/1989 | Newcomb et al. | 473/570 |
| 4,989,881 | A * | 2/1991 | Gamble | 473/570 |
| 5,083,799 | A * | 1/1992 | Thill | 473/588 |
| 5,403,000 | A * | 4/1995 | Woosley | 473/447 |
| 5,415,151 | A * | 5/1995 | Fusi et al. | 124/56 |
| 5,508,893 | A | 4/1996 | Nowak et al. | |
| 5,591,032 | A | 1/1997 | Powell et al. | |
| 5,882,239 | A * | 3/1999 | Trichak | 446/46 |
| 6,574,945 | B2 | 6/2003 | Martinez, Jr. | |
| 6,874,906 | B1 | 4/2005 | Dorney | |
| 6,905,428 | B1 * | 6/2005 | Lang | 473/411 |
| 6,971,940 | B2 * | 12/2005 | Cohen et al. | 446/47 |
| 7,040,308 | B2 | 5/2006 | Ciesiun | |
| 7,777,208 | B2 * | 8/2010 | Cranor | 250/504 R |
| 2001/0002741 | A1 | 6/2001 | Skeuse et al. | |
| 2006/0065258 | A1 | 3/2006 | Lovell | |
| 2010/0035710 | A1 | 2/2010 | Smith | |
| 2011/0037226 | A1 * | 2/2011 | Nickles | 273/343 |

* cited by examiner

*Primary Examiner* — Mark Graham
(74) *Attorney, Agent, or Firm* — Renner Kenner Greive Bobak Taylor Weber

(57) ABSTRACT

An illuminated skeet target comprises a substantially disc-shaped body that is suitable for launching via a trap or other launching device. The skeet target contains at least two reagents that undergo a chemiluminescent reaction and give off light when combined so that the skeet target can be illuminated and identified when ambient lighting conditions are insufficient.

3 Claims, 4 Drawing Sheets

ILLUMINATED SKEET TARGET

CROSS-REFERENCE TO RELATED APPLICATIONS

This application is a continuation-in-part of U.S. patent application Ser. No. 12/154,953, filed May 28, 2008 now abandoned, which claims priority of U.S. Provisional Patent Application No. 60/932,055, filed May 29, 2007.

TECHNICAL FIELD

This invention relates to a luminescent or lighted skeet target and, more specifically, to a skeet target that is illuminated by chemiluminescence. Such a skeet target is better illuminated for shooting during dusk or dark conditions.

BACKGROUND OF THE INVENTION

New twists on traditional sports have sparked a resurgence in their participation. For example, a twist on bowling is the use of luminescent pins instituted in alleys for "glow-in-the-dark" games. Another example is the indoor "glow-in-the-dark" miniature golf courses that utilize a means to illuminate golf balls and the associated holes or cups. Similar efforts have been made to adapt activities performed during the day-time, more suitable for evening play. For example, many golf-courses now offer "glow-in-the-dark" golf during night-time hours. The concept of playing these sports in dark conditions is strikingly imaginative because they all require precision and accuracy to engage an illuminated target.

Skeet shooting is also a sport that requires a precise and an accurate shot and, therefore, it is commonly played during daylight because dusk or darker lighting conditions make the skeet target less visible. In contrast to the bowling pins and golf balls/holes, a skeet target, or "clay pigeon," is a moving target that reaches approximately 90 mph. For this reason, the sport of skeet shooting has not yet adapted a means for illuminating the skeet target so as to enable skeet shooting at dusk or nighttime. However, with respect to current "glow-in-the-dark" activities to date, any innovation in illumination as associated with firearms, has been directed toward "tracers" or otherwise illuminating the ammunition, and not the target. Such innovations are meaningless in the sport of skeet shooting as only a single shot, or perhaps two, are ever directed toward a single target. Under such circumstances, tracing the fired ammunition is not of any value or benefit.

The present invention teaches a novel luminescent skeet target that provides a means for a skeet shooter to participate in the sport during dusk, or other conditions where ambient light is not sufficient to identify the skeet target. By illuminating the skeet target, rather than the ammunition used to shot at it, the user can shoot into the dark (perhaps from a lighted location) toward the visually illuminated skeet target.

Chemiluminescence is the emission of light with limited emission of heat (luminescence), as a result of a chemical reaction. Given two reactants, A and B, with an excited intermediate, light is produced. For example if one reactant is luminol and another reactant is hydrogen peroxide in the presence of a suitable catalyst, then there can be produced an excited intermediate that fluoresces as it decays to a lower energy level.

The use of chemiluminescence is known to illuminate certain objects. However, while it has been used to illuminate objects that are thrown or otherwise fly through the air, it has not been used to illuminate targets that fly through the air.

Therefore, there is a need in the art for an illuminated and preferably, chemiluminscent, skeet target that can be used when ambient lighting conditions are not sufficient to otherwise see the skeet target. In addition, there is a need for an illuminated trap from which a skeet target is launched into the air to enable one to see the skeet target prior to its launch.

SUMMARY OF THE INVENTION

One aspect of the present invention may be to provide for an illuminated skeet target comprising a body formed from a sulfur binder, fly ash and calcium carbonate; and a raised ridge extending from an outer surface of said body, said ridge formed of acrylic, fluorescent material; wherein said ridge maintains at least one portion that is coated with a surface layer having a refractive index that absorbs light.

Another aspect of the present invention may be to provide a skeet target comprising a substantially disc-shaped body; a raised ridge extending from an outer surface of said body, said ridge maintaining at least one portion that is coated with a surface layer having a refractive index that absorbs light; and an illumination element in operative communication with said raised ridge, wherein said illumination element is selected from the group consisting of: luminescent coating, luminescent material, and incandescent lighting.

Still another aspect of the present invention may provide a method of shooting skeet comprising the steps of containing a target in a trap until it is launched; activating a means to emit light from said target; and launching said target from said trap; wherein said trap launches said skeet target such that said skeet target illuminates to become visible to a shooter.

Yet another aspect of the present invention may provide a method of shooting skeet comprising the steps of illuminating a skeet target by a skeet trap; and launching said skeet target from said trap; wherein said launched target is fired on by a user.

A further aspect of the present invention may provide an illuminated target comprising a body defining a first volume and a second volume. The first volume is separated from the second volume by a barrier. The first volume contains a first reagent, typically in the presence of a catalyst, and the second volume contains a second reagent, and the first reagent and the second reagent undergo a chemiluminescent reaction and emit light when mixed.

Yet another aspect of the present invention may provide a method of using an illuminated target comprising the steps of providing at least one target and initiating a chemiluminescent reaction in said at least one target.

BRIEF DESCRIPTION OF THE DRAWINGS

One or more objects and advantages of the present invention will become apparent from the subsequent detailed description of the preferred embodiment and the appended claims taken in conjunction with the accompanying drawings where:

PREFERRED EMBODIMENTS FOR CARRYING OUT THE INVENTION

Figure 1A:
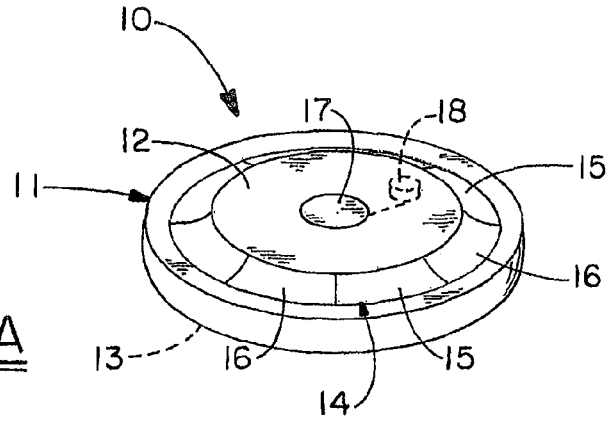
FIG. 1A is a perspective view of an illuminated skeet target in accordance with the concepts of the present invention.
Figure 1B:
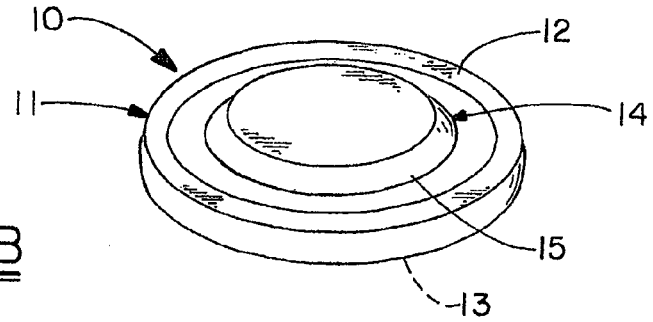
FIG. 1B is a perspective view of the illuminated skeet target having an elevated ridge that has layered coated and non-coated portions in accordance with the concepts of the present invention.

It is a feature of the present invention to provide an illuminated skeet target 10 so that a sportsman may skeet shoot in the evening and night, or any other time when ambient lighting is not sufficient to see the skeet target 10. For the purposes of the following discussion, the term "skeet target" is defined herein as any skeet, clay pigeon, or other suitable target that can be launched in the air for the purpose of being shot at with a projectile, such as a bullet from a gun. Furthermore, the teachings of U.S. Pat. Nos. 4,124,550; 6,085,427; and 7,174,904 are incorporated herein by reference. An illuminated skeet target 10 comprises a disc-shaped body 11 having an upper surface 12 that is opposite a lower surface 13, as shown in FIGS. 1A-B. Although the target 10 is shown as being substantially disc-shaped, it may be formed as any shape suitable for launching into the air. In one aspect, the skeet target 10 may be shaped similar to that of a conventional clay pigeon. The skeet target 10 maintains an elevated or raised ridge 14 that extends about an outer circumference of the upper surface 12 of the skeet target 10. In other words, the elevated ridge 14 may circumscribe or partially circumscribe the upper surface 12 of the target 10. However, it should be appreciated that the ridge 14 may be arranged in any desired position upon the upper surface 12 of the body 11. In one aspect, the raised ridge 14 assists in a stacking of skeet targets 10, and also increases the aerodynamics of the skeet target 10 as well.

Continuing, the skeet target 10 may be manufactured from any suitable material, and thus the skeet target 10 may be formed from acrylic, a composite of tar pitch and lime, or it can be manufactured from a sulfur binder and fillers in the form of fly ash and calcium carbonate. In addition, it should also be appreciated that the target 10 may take on any desired color, such as black for example. The elevated ridge 14, however, is manufactured from an acrylic, fluorescent plastic, a luminous nylon or another material that possesses a light absorption and light guidance capability. Portions of the circumferential surface of the elevated ridge 14 are coated with a surface layer 15 having a refractive index, such that ambient light may be absorbed through portions and substantially reflected, (i.e. mirrored), inside the ridge 14. The ambient light is directed to the remaining portions of the surface layer 15 that is not coated. The light is then emitted through the non-coated portions 16 of the ridge 14. The coated and non-coated portions 16 may be alternating (as shown in FIG. 1A) or they may be layered (as shown in FIG. 1B).

In an alternative embodiment, the entire skeet target 10 may be comprised of the fluorescent material so long as it comprises the characteristics desired in skeet shooting, i.e., it shatters when struck by a bullet or other projectile (not shown). In one aspect, the material forming the skeet target 10 may be an environmentally friendly so that it causes no risk of harm to humans or animals.

In another aspect, the skeet target 10 may be formed from transparent or partially transparent material. In addition, the skeet target 10 may maintain an illumination device 17 or light source to enable the skeet target 10 to be illuminated. For example, the illumination device 17 may comprise any suitable incandescent, electroluminescent, or gas-discharge based lighting source, including but not limited to LED (light emitting diodes) lights, HID (high intensity discharge) lights, and the like. In addition, the illumination device 17 may be powered by any suitable power source 18, such as a battery. Furthermore, the skeet target 10 may be formed, coated, or otherwise treated with any suitable luminescent material so as to illuminate the skeet target 10. In addition, the skeet target 10 may be configured such that only a portion or the entire portion of the skeet target 10 is illuminated. The skeet target 10 may also be configured so that it transitions between illuminated and non-illuminated states depending on whether the target 10 is launched in the air or is awaiting launch. It is also contemplated that the illumination of the target may be controlled to be on or off by any suitable switching device and/or suitable control device. It should also be appreciated that the illumination device 17 may be configured so that it flashes on and off in accordance with any suitable sequence.

Figure 2:
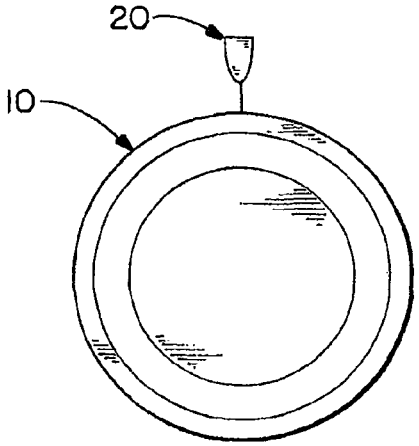
FIG. 2 is a top plan view of the illuminated skeet target with attached illuminated birdie in accordance with the concepts of the present invention.

FIG. 2 shows an illuminated indicator or birdie 20 according to an alternate embodiment of the present invention, wherein the birdie 20 trails the skeet target 10. Essentially, a light-absorbent, acrylic birdie 20 displays or follows the flight path of the skeet target 10 launched from a trap. It is envisioned that the birdie 20 is of a minimal size relative to that of the skeet target 10 so as to not take away from the challenge of shooting it down. The birdie 20 is alternatively coated with a surface layer having a refractive index such that an ambient light is absorbed through the surface, reflected inside the target and then emitted through a non-coated portion of the target. It should also be appreciated that the birdie 20 may also be configured to include the illumination device 17, and/or be configured with luminescent material as previously discussed with regard to the skeet target 10, and/or may be configured to include chemiluminescent reactants within acrylic materials as discussed below.

Figure 3:
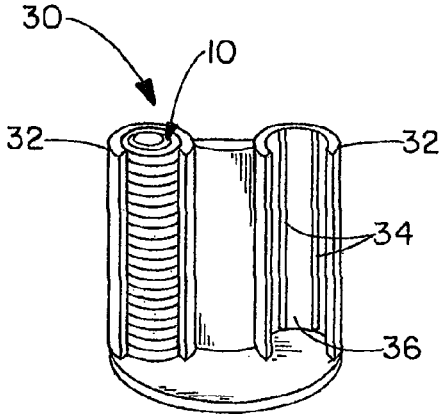
FIG. 3 is a perspective view of an illuminated trap used to launch the skeet target in accordance with the concepts of the present invention.

FIG. 3 shows a portion of a trap 30 that is used to launch the skeet target 10 into the air. In particular, the skeet targets 10 are stacked in substantially vertical columns 32 prior to their being launched by the trap 30. It is anticipated that one or a plurality of light sources 34 travels a length of the interior wall 36 of the column 32. At the times when an illuminated skeet target 10 is desired, the light source 34 is activated by the shooter to emit the light absorbed by the acrylic portions of a skeet target 10. Chemiluminescence can be activated in any of a number of ways as discussed below. The launcher can be mechanical or electronic, movable or immovable, rotatable or non-rotatable, and of any size suitable for use.

During operation of the trap 30, the skeet targets 10 remain within the columns 32 until a skeet target 10 is launched. When ambient lighting is not sufficient to effectively illuminate the skeet target 10, a means, such as a switch, is activated so that the column 32 that contains the skeet target 10 is illuminated by a suitable light source, such as light source 34, which may comprise that discussed with regard to the illumination device 17 previously discussed. The ambient light is absorbed through the partially coated surface of the trap 30 so that the ambient light is completely reflected inside the trap 30. The absorbed light is then emitted through the non-coated portions of the skeet target 10. The trap 30 launches the skeet target 10 substantially simultaneously as the light is absorbed so that it is emitted through the non-coated portions 16 of the target 10 as it travels through the air. In this manner, the skeet target 10 illuminates to become more visible to a shooter.

It should also be appreciated that the trap 30 used to launch the target 10 may be configured so that a suitable light source (not shown) illuminates the skeet target 10 before it is launched, while it is being loaded.

In another aspect, a skeet target is provided and is selectively illuminated by chemiluminescence. Chemiluminescence refers to the emission of light with limited emission of heat as the result of a chemical reaction. Typically, when light is desired, two reagents are combined, often in the presence of a catalyst, and react to form an excited intermediate composition. The excited intermediate composition decays into a lower energy state either through fluorescence or phosphorescence, depending on the intermediate composition. Chemiluniscent reactions are known, and the color of light emitted during the reaction may be controlled through the addition of dyes or other appropriate materials to the reagents. Non-limiting examples of known reagents that can have chemiluminescent reactions include: luminal, cyalume, oxalyl chloride, tetrakis(dimethlyamino)ethylene, and 1,2,3-trihydroxibenzene. Often, hydrogen peroxide is used as a second reagent in chemiluminescent reactions as an oxidizer. Non-limiting examples of dyes (also referred to as sensitizers) include: 9,10-diphenylanthracene (blue), 9,10-bis(phenylethynyl)anthracene (green), tetracene (yellow-green), 1-chloro-9,10-bis(phenylethynyl)anthracene (yellow), 5,12-bis(phenylethynyl)naphthacene (orange), and rhodamine B (red). The light that is emitted as part of a chemiluminescent reaction persists at an intensity and for a period of time depending on the selection of the reagents. The selection of the reagents is within the skill of one in the art, but because the skeet target will be shot, non-toxic and biodegradable materials are preferred.

Figure 4:
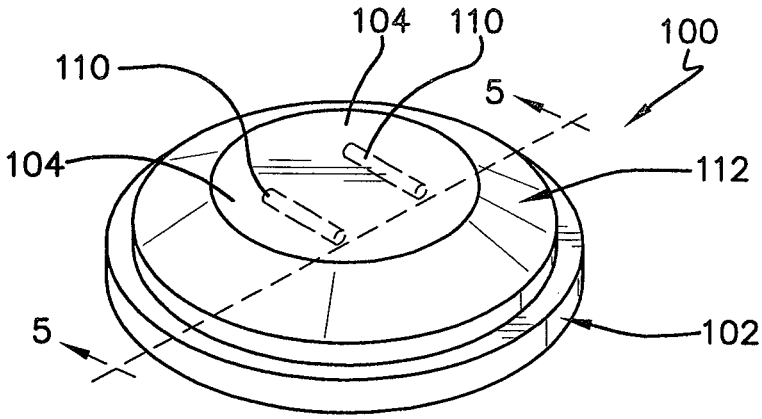
FIG. 4 is a perspective view of an illuminated skeet target in accordance with further aspects of the present invention.
Figure 5:
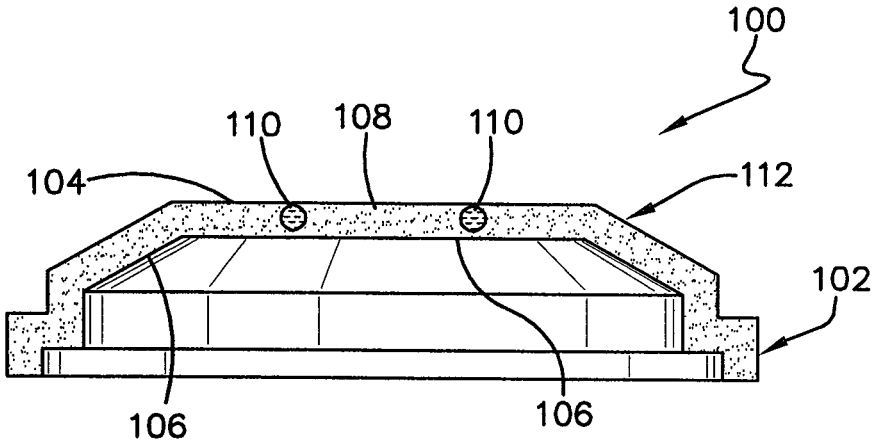
FIG. 5 is a fragmented side view of the illuminated skeet target depicted in FIG. 4.

Referring to FIGS. 4 and 5, a skeet target 100 is shown and may be substantially disc-shaped and of any type or shape useful in the target shooting arts. Target 100 includes a body 102 having an upper surface 104 and a lower surface 106. An empty volume space 108 is defined between upper surface 104 and lower surface 106. Volume space 108 contains one reagent to a chemiluminscent reaction, and optionally one or more of a catalyst and dye. All or a portion of the body 102 may be formed of a generally translucent acrylic composition that generally allows for the transmission of light through the body 102. One or more containers 110 are positioned within volume space 108, and in at least one embodiment, are situated in the region of the elevated ridge portion 112 of target 100. Each container 110 is constructed of a frangible material and defines within it volume containing a second reagent to a chemiluminescent reaction, and optionally one or more of a catalyst and dye. Container 110 is shown having a closed cylinder shape, but may take any appropriate form. Container 110 initially serves as a barrier between the two reagents, but because it of its construction, may be broken, thereby allowing the two reagents to come into contact. A user may break container 110 in any number of ways, including for example, by applying a compressive force on target 100 in the vicinity of container 110 until container 110 breaks, or by bending body 102, generally in a direction across the length of the cylinder-shaped containers 110. When the container 110 is broken and the two reagents are brought into contact and mix, a chemiluminescent reaction is initiated and light is emitted. The translucent construction of body 102 allows the light to be transmitted outside target 100 and perceived by a user. Advantageously, a user will perceive the light when viewing either the upper surface 104 or the lower surface 106.

Figure 6:
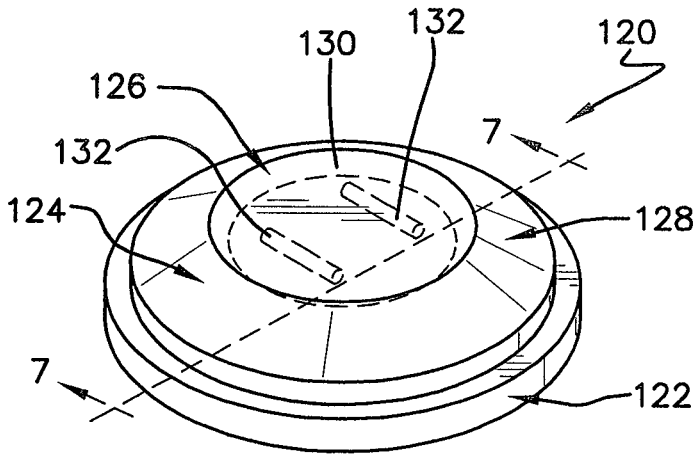
FIG. 6 is a perspective view of an illuminated skeet target in accordance with further aspects of the present invention.
Figure 7:
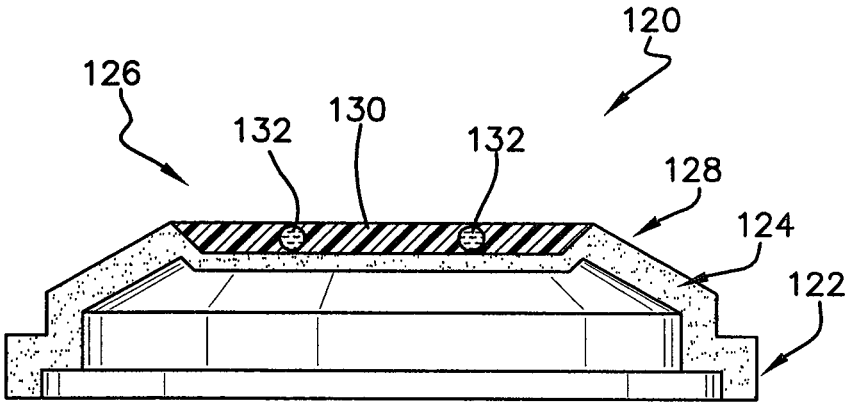
FIG. 7 is a fragmented side view of the illuminated skeet target depicted in FIG. 6.

Referring to FIGS. 6 and 7, skeet target 120 is shown and includes a portion that can be illuminated by a chemiluminescent reaction. Target 120 has a body 122 that is substantially disc-shaped and of any type or shape useful in the target shooting arts. Body 122 includes a clay portion 124 and an insert 126, which insert is situated in the region of, and forms a part of, an elevated ridge portion 128. In other embodiments, the insert may be positioned elsewhere to allow the selective illumination of any portion of the body 122. Clay portion 124 may be constructed of materials typically used in the construction of sporting clay targets such as skeet targets, and can include pitch and pulverized limestone rock. Insert 126 defines within it an interior volume space 130. Volume space 130 contains one reagent to a chemiluminscent reaction, and optionally one or more of a catalyst and dye. One or more containers 132 are positioned within volume space 130. Each container 132 is constructed of a frangible material and defines within it a volume containing a second reagent to a chemiluminescent reaction, and optionally one or more of a catalyst and dye. In all critical respects, container 132 is identical to and performs the same as container 110, described above. Container 132 initially serves as a barrier between the two reagents, but because it of its construction, may be broken, thereby allowing the two reagents to come into contact. Container 132 may be broken by a user by applying a compressive force on insert 126. Care should be taken not to bend target 120, since a substantial portion of body 122 is the clay portion 124, which is easily broken. When the container 132 is broken and the two reagents are brought into contact and mix, a chemiluminescent reaction is initiated and light is emitted. All or a portion of the insert 126 may be formed of a generally translucent acrylic composition that generally allows for the transmission of light, thereby allowing the light to be transmitted outside insert 126 and perceived by a user.

Figure 8:
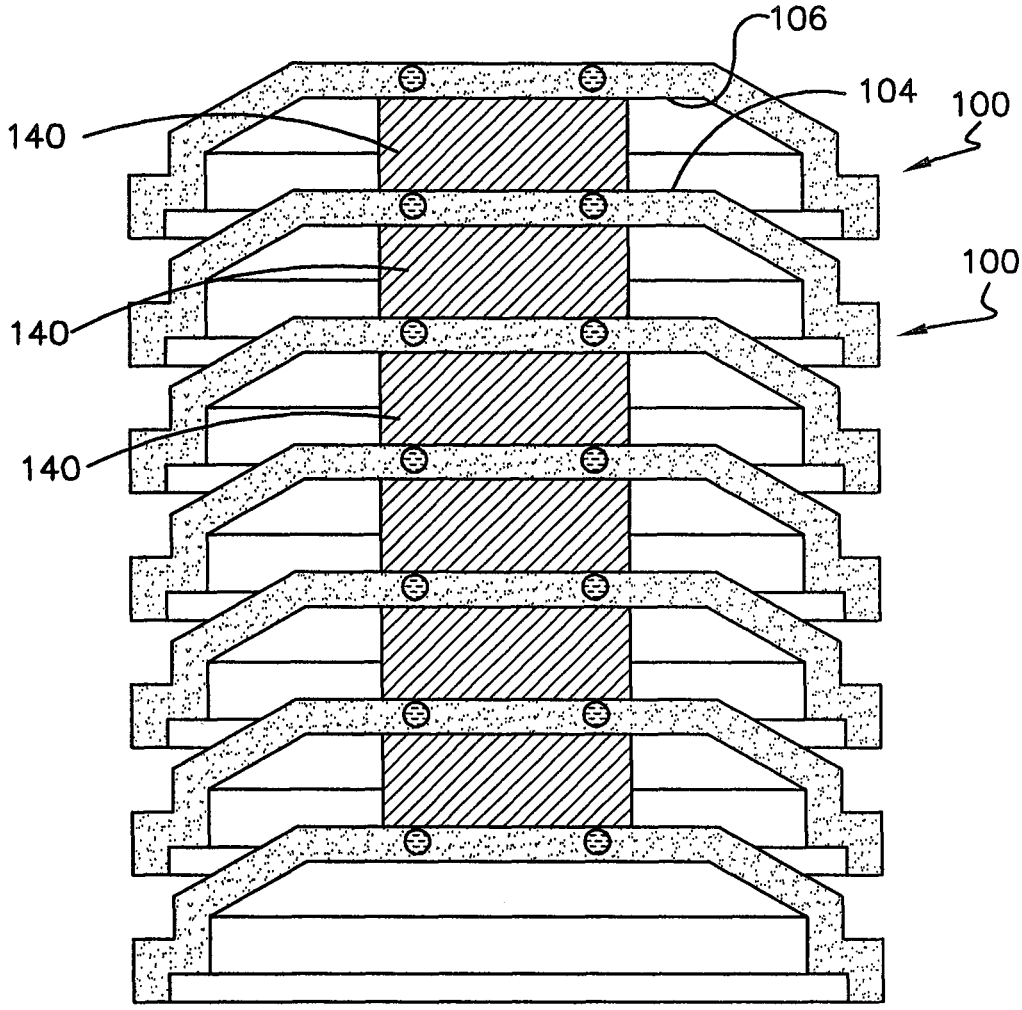
FIG. 8 is a fragmented side view of a stack of illuminated skeet targets as depicted in FIG. 5, with a spacers between the targets.

A chemiluminescent reaction may be initiated at any time for targets 100, 120. Advantageously, the chemiluminescent reaction is initiated before a target is launched and shot. As discussed above, the chemiluminescent reaction is initiated by breaking the barrier between the reagents, and this may be done either individually, or on several targets at a time. Turning to FIG. 8, a stack of targets, such as targets 100, are shown, with a spacer 140 positioned between adjacent targets. Particularly, each spacer 140 is positioned just below the lower surface 106 of a target and extends to the upper surface 104 of the target below. In such an arrangement, a user applies a compressive force to the uppermost target in the stack, and the force is transferred down through the stack by spacers 140. If sufficient compressive force is applied, the containers in all targets will be broken, thereby causing the reagents to come into contact, mix, and react and emit light.

Once illuminated, one or more targets 100, 120 may be launched according to any known method for a user to shoot at. For example, a shooter or a shooter's companion might provide a target 100 and initiate the chemiluminescent reaction in it, then launch the target skyward. Once launched, the illuminated skeet target provides an improved target for low-light shooting settings and may be shot by the shooter using any suitable ammunition, such as bird shot.

In light of the foregoing, it should thus be evident that the process of the present invention, providing a chemiluminescent skeet target, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A method of using an illuminated target comprising the steps of:

providing at least two adjacent targets having a spacer positioned there between and initiating a chemiluminescent reaction in one of said targets by applying a compressive force to said one target and the spacer between said one target and a the second adjacent target.

2. The method of claim 1 further comprising the step of launching said one target.

3. The method of claim 2 further comprising the step of shooting said one target.

* * * * *